US007802740B2

(12) United States Patent
Dziesinski et al.

(10) Patent No.: US 7,802,740 B2
(45) Date of Patent: Sep. 28, 2010

(54) SHREDDING MACHINE

(75) Inventors: Kris D. Dziesinski, Alpena, MI (US); Randy L. Beaudoin, Ossineke, MI (US); Jeffrey L. Beaudoin, Ossineke, MI (US)

(73) Assignee: Amos Mfg., Inc., Alpena, MI (US)

( * ) Notice: Subject to any disclaimer, the term of this patent is extended or adjusted under 35 U.S.C. 154(b) by 60 days.

(21) Appl. No.: 11/770,789

(22) Filed: Jun. 29, 2007

(65) Prior Publication Data

US 2007/0284462 A1 Dec. 13, 2007

Related U.S. Application Data

(62) Division of application No. 10/957,466, filed on Oct. 1, 2004, now Pat. No. 7,284,715.

(60) Provisional application No. 60/509,077, filed on Oct. 6, 2003.

(51) Int. Cl.
*B02C 7/14* (2006.01)
*B02C 19/00* (2006.01)

(52) U.S. Cl. ..... 241/36; 241/60; 241/79.1; 241/100

(58) Field of Classification Search ..... 241/37.5, 241/99, 100, DIG. 14, 60, 79.1
See application file for complete search history.

(56) References Cited

U.S. PATENT DOCUMENTS 4,489,897 A * 12/1984 Turner et al. ..... 241/167
4,579,287 A * 4/1986 Brown ..... 241/36
4,655,404 A * 4/1987 Deklerow ..... 241/99
4,729,515 A 3/1988 Wagner
4,923,126 A 5/1990 Lodovico et al.
4,979,683 A 12/1990 Busdeker
5,092,527 A * 3/1992 Perry et al. ..... 241/19
5,150,843 A 9/1992 Miller et al.
5,178,336 A 1/1993 Lodovico et al.
5,205,497 A * 4/1993 Deklerow ..... 241/36
5,474,239 A 12/1995 Williams et al.
5,575,429 A * 11/1996 Muller-Girard ..... 241/36
5,743,473 A * 4/1998 Gregg ..... 241/33
5,769,336 A 6/1998 Emmerson
5,871,162 A 2/1999 Rajewski
6,065,696 A 5/2000 Tsai
6,311,908 B1 11/2001 Kajiyama et al.

(Continued)

*Primary Examiner*—Faye Francis
(74) *Attorney, Agent, or Firm*—Warner Norcross & Judd LLP

(57) ABSTRACT

A shredding machine having a plastics loading section and a paper loading section. The two loading sections feed material to be shred into a single cutting section. The plastics loading section may include a ram that urges loaded materials into the cutting section for shredding. The cutting section may include a plurality of cutters mounted on a pair of adjacent cutting shafts. The cutters on one shaft are intermeshed with the cutters on the other shaft. The cutting shafts rotate in opposite directions to cut apart materials fed into the cutting head. The teeth of one cutter are offset from the those of adjacent cutters to evenly distribute the forces generating during cutting. The machine may include a material collection/filtration system having a vacuum that creates a negative pressure in the cabinet and a filtration bag for collecting the shredded material. The filtration system may also include a HEPA filter for collecting airborne particles that are not captured in the filtration bag.

14 Claims, 13 Drawing Sheets

Simplified top view of the cutting section and drive components of the cutting head.

U.S. PATENT DOCUMENTS

| | | | | |
|---|---|---|---|---|
| 6,641,066 | B2 * | 11/2003 | Kamiya | 241/47 |
| 6,978,954 | B2 * | 12/2005 | Kroger et al. | 241/36 |
| 2001/0025895 | A1 * | 10/2001 | Kamiya | 241/99 |
| 2003/0006330 | A1 | 1/2003 | Chang | |
| 2005/0145730 | A1 | 7/2005 | Domanico | |

* cited by examiner

FIG. 1: Simplified top view of the cutting section and drive components of the cutting head.

FIG. 2: Simplified sectional view of the collection system.

FIG. 3: Right hand elevational view of FIG. 1 including various features of the invention.

FIG. 4: Left hand elevational view of FIG. 1 including various features of the invention.

FIG. 5: Simplified auxiliary top view of FIG. 4 showing various features of the ram and housing, and their related components.

FIG. 6: Simplified auxiliary rear view of FIG. 4 showing various features of the ram and the housing, and their related components.

FIG. 7: Simplified front view of the machine taken from FIG. 1.

FIG. 8: Simplified rear view of the machine taken from FIG. 1.

FIG. 9: Simplified sectional view of the cutting section, loading sections, ram, ram housing, and the paper deflector of the machine.

FIG. 10: Simplified three dimensional front view of the outer features of the invention.

FIG. 11: Simplified three dimensional rear view of the outer features of the invention.

FIG. 12: Simplified profile view of an individual cutter.

FIG. 13: Simplified three dimensional view of a partial cutter stack-up showing the angular relationship of cutting teeth and upper and lower shafts.

SHREDDING MACHINE

This is a division of U.S. application Ser. No. 10/957,466, filed Oct. 1, 2004 (now U.S. Pat. No. 7,284,715). U.S. patent application Ser. No. 10/957,466 (now U.S. Pat. No. 7,284, 715) claims the benefit of U.S. Provisional Patent Application No. 60/509,077, which was filed on Oct. 6, 2003.

BACKGROUND OF THE INVENTION

The present invention relates to shredding machines and more particularly to a shredding machine that is particularly well suited to provide the destruction of waste products that may contain confidential medical information generated by retail pharmacies.

The use of shredding machines is a well-known practice, that varies greatly in both application and operation. Shredding machines are used to shred a variety of products ranging from light-weight paper to heavier items, such as thin-walled containers. Existing machines differ by design to withstand the specific rigors of their particular application, and for use in the specific type of environment in which they will be operating.

A shredding machine used in the shredding of disposable containers is shown in U.S. Pat. No. 5,178,336 to Lodovico et al, which is directed to a machine claiming an improved method of cutting into small pieces the thin wall material of disposable containers such as plastic bottles or metal cans. Prior shredding machines are shown in U.S. Pat. No. 4,923, 126 to Lodovico et al and U.S. Pat. No. 4,729,515 to Wagner.

Despite the existence of a variety of shredding machines, there remains a need for a shredding machine that is well-suited for use in pharmacies and particularly in retail pharmacies that provide services directly to consumers. Under current governmental regulation (e.g. HIPAA), pharmacies are strictly required to protect the confidential information of customers. These requirements extend to information that may be contained in paperwork or on the labels applied to pharmaceutical containers. Some of the current practices for disposal of this waste includes manual destruction of labels and paperwork, and contracting disposal services to take bottles and labels to a shredding center. Removing the bottles from the pharmacy site does not allow observation and therefore confirmation by the pharmacy staff that the labels have been destroyed per HIPAA requirements. Also, the current disposal processes requires two steps instead of one to complete.

SUMMARY OF THE INVENTION

The aforementioned problems are overcome by the present invention wherein a shredding machine is provided to cut any of a numerous sizes of disposable plastic pharmaceutical containers and their labels into small pieces in a way that the confidential information on the label is completely destroyed. In one embodiment, the unit also effectively shreds paper products and cardboard in a separate compartment. The shredding machine may include separate loading sections for loading containers and paper products.

In one embodiment, the shredding machine includes a ram and ram housing that cooperatively feed containers into the cutting section. The ram housing may include a door that is opened to permit insertion of containers into the ram housing and closed to initiate operation of the ram and cutting section. The ram is selectively extendable to urge the containers into the cutting section. In one embodiment, the head of the ram is configured to provide a guide for directing paper materials loaded through the paper loading section into the cutting section.

In one embodiment, the shredding machine includes a material filtration/collection system. The material filtration/collection system includes a vacuum and a filtration bag. The vacuum is mounted to draw air in through the container and paper load compartments down through the cutting section. This negative pressure draws shredded products and other lose material from the loading compartments down through the cutting section and into the filtration bag. The system may also include a HEPA filter that is mounted in the air flow path downstream from the filtration bad to collect any remaining air borne particles that may have passed through or around the filtration bag.

In one embodiment, the machine starts automatically when the door to the plastics loading compartment is closed after inserting the containers to be shred. As noted above, the machine may include a ram that is used to exert force and persuade the bottles into the cutters. The control system may be configured to stop the cutting section when the ram is fully extended or a fixed period of time thereafter. With paper products, the machine may start automatically when paper is fed into the paper chute, and may stop automatically when paper is not present. The unit may also include a filtration system that create a negative pressure at infeed areas to collect any air born fibers or debris that is produced during operation, which may also be fed through a HEPA filter. The shredded material may be fed into a filter bag that allows air to flow through the bag yet contain the product, which complies with biohazard requirements. The machine may include a sensor that is tripped when the bag is full of material and an indicator light will alert the operator that the bag is full.

In various embodiments, the machine may include the following and other unique characteristics:

1. Cutter Head—The cutter head is mounted at an angle of 40-degrees from vertical in the illustrated embodiment, but could be mounted at any angle from 0-degrees to 90-degrees. This allows the paper to be fed in from the top of the machine and plastic bottles perpendicular to the angle of the cutter head. The cutters are positioned on the cutter head shafts in an angular relation to each other which keeps the torque requirements of shredding to a minimum. Spring plates on each side keep tension on the cutters to prevent the cutting edges from separating. The spring plates also absorb a substantial amount of the side load generated by the shredding, and distribute the force throughout the side frames. The spring plates may be replaced by other conventional mechanisms for maintaining tension on the cutter. The cutter head may also have a series of combers which are designed and positioned so that they form a throat to accept the various sizes of bottles, and also allow the paper products to be fed from the top.

2. Ram and Ram Housing—The ram and ram housing have a direct relationship to each other in the shredding of plastic bottles, labels, and paper. Because the housing is at an angle perpendicular to the cutter head, the ram and ram housing each have two functions: 1) The housing provides a chamber to insert plastics and guides the ram, and it also makes up approximately 50% of the paper deflector. 2) The ram not only forces the plastic waste into the cutter head by a pneumatic cylinder, it also makes up the remaining 50% of the paper deflector when it is not shredding plastic products. The ram applies a pre-determined downward force on the product, and also helps to control the product as it enters the cutter head.

3. Controls—In one embodiment, the machine includes a control system having a programmable logic controller that is used to control overall operation of this machine and it's applications. The control system may control operation of a filtration system that creates negative pressure at infeed areas to collect airborne fibers produced during operation. The control system may also includes a master on/off switch at the rear of the machine to stop the flow of electrical current. The control system may further include sensors to indicate when the machine is on, when paper is present, and when the material bag is full. In one embodiment, a sensor switch on the infeed compartment door starts the shredding cycle for bottles when closed, and also stops operation anytime the door is open. In one embodiment, a sensor switch on the sprocket detects shaft speed, and when the unit is stalled or stopped. The control system may vary from application to application.

4. Material Collection/Filtration System—As noted above, the machine may also include a material collection/filtration system. In one embodiment, the material filtration bag is mounted on the underside of the machine cabinet, which separates the shredder chamber and the product collection chamber of the cabinet. In this embodiment, the filtration bag collects and captures all of the shredded product generated by the shredder. The material bag may be made from a fiber that allows air to flow through it. In addition, airborne particles not captured in the filtration bag may be captured by a HEPA filter. Other potentially biohazardous material is pulled into the bag by a negative pressure system designed into the cabinet. The machine may include alternative collection and/or filtration systems.

The present invention provides a simple, effective shredding machine that is particularly well-suited for use in a retail pharmacy, as well as other settings where it may be desirable to shredding both paper materials and thin-wall containers. The machine is clean, attractive, and operates with a low noise level for a "pharmacy-friendly" environment. In one embodiment, the two loading sections provide a simple and effective mechanism for loading different types of materials into the machine for feeding into a single cutting section. The cutting heads and combers of one embodiment provide a durable and effective cutting operation that destroys any confidential information that may be contained on the shredded material. The filtration system of one embodiment reduces the risks associated with airborne particles generated during the shredding process. The various features of the machine help create a safer and more healthy environment for the pharmacy staff and it's customers.

These and other objects, advantages, and features of the invention will be readily understood and appreciated by reference to the detailed description of the preferred embodiments and the drawings.

DETAILED DESCRIPTION OF THE PREFERRED EMBODIMENT

A shredding machine in accordance with one embodiment of the present invention is shown in FIGS. 1-13. The machine (10) is particularly well-suited for shredding pharmaceutical waste such as laser copy/printer paper, pressure sensitive label material, pamphlets, brochures, various containers, such as vitamin bottles that have thick folded instructions attached to the outside of the containers, post consumer plastic containers with or without pressure sensitive labels attached which also could contain a solid residue, and PETE plastic bottles with or without pressure sensitive labels attached which also could contain a liquid residue. Also, all of the pharmaceutical waste mentioned above would generally contain personal and confidential information, which may be subject to strict governmental regulations, such as HIPAA.

Figure 10:
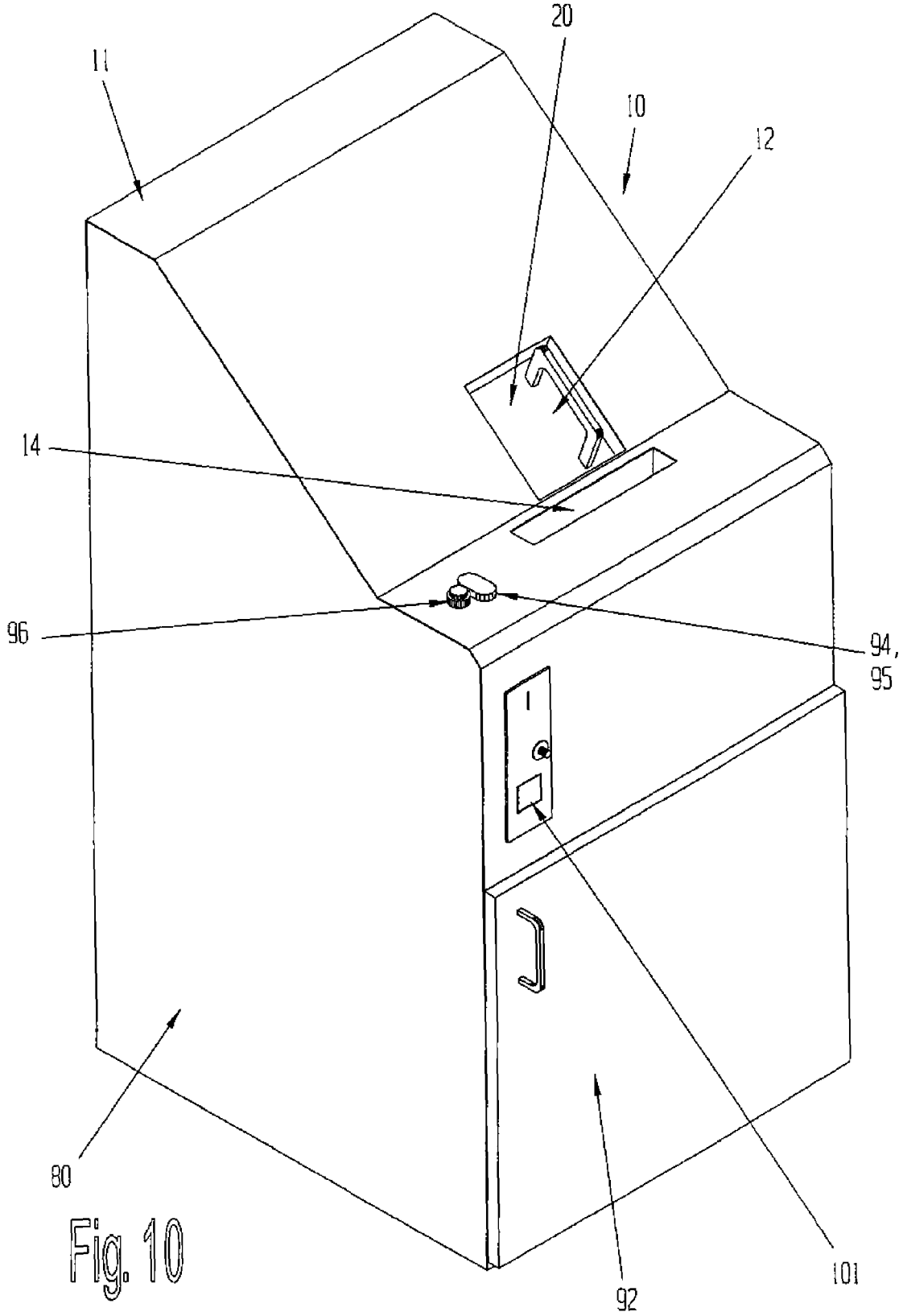
FIG. 10 is a simplified front perspective view of the outer features of the Invention.
Figure 11:
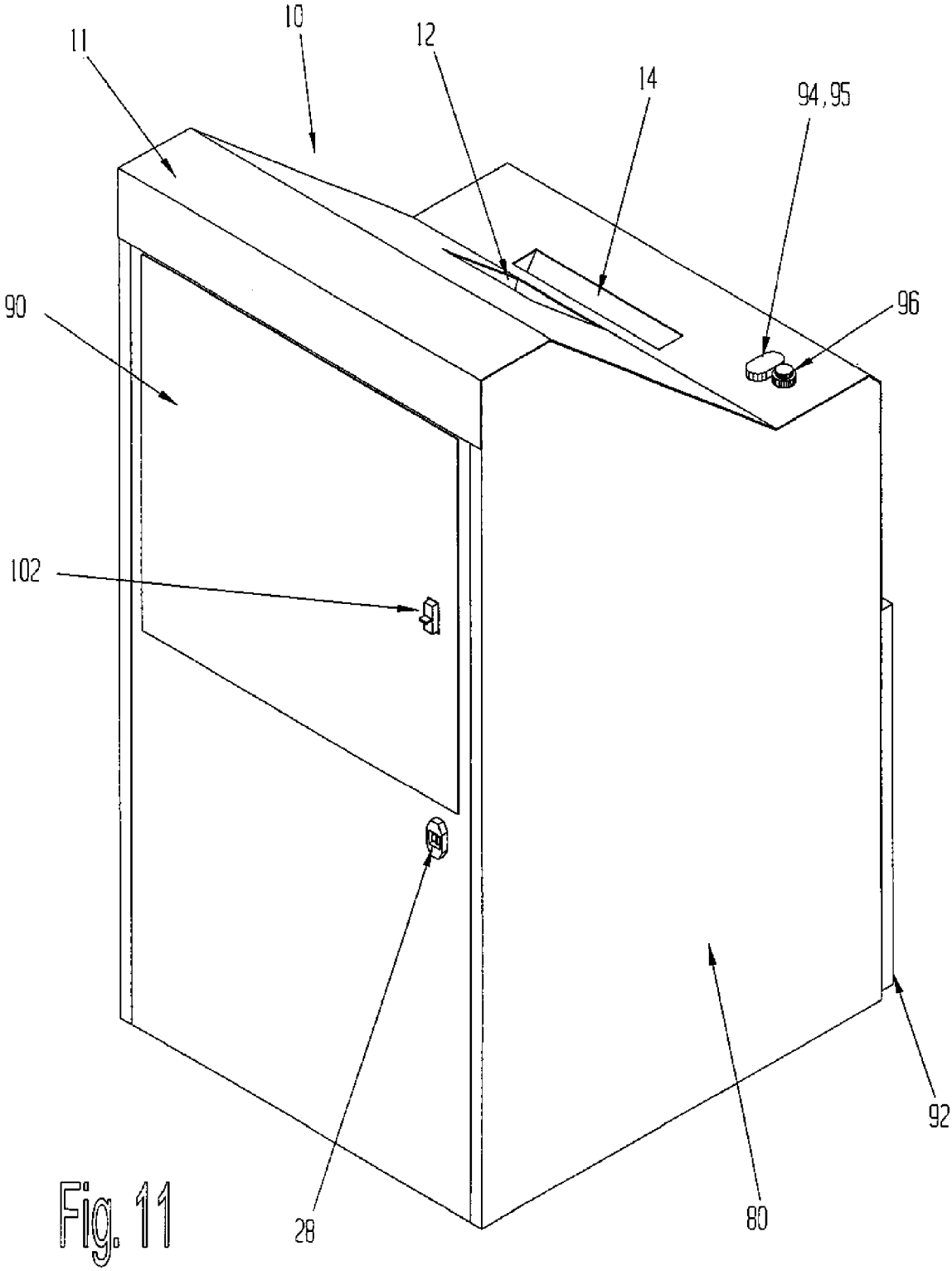
FIG. 11 is a simplified rear perspective view of the outer features of the invention.

Referring now to FIG. 10, the machine (10) generally includes a housing or formed cover (11) that contains a plastics loading section (12) for loading plastic bottles and containers; a paper loading section (14) for loading laser copy/printer paper, pressure sensitive label material, pamphlets and brochures; a cutting section (16) for shredding the loaded materials and a collection section (18) for collecting the shredded materials. The machine (10) is the type which can be utilized in a pharmacy or any facility that has a pharmaceutical waste product and has a need to shred these products and to comply with governmental regulations, such as HIPAA privacy laws. The machine (10) is shown with sufficient detail to describe various operating components and features which are specifically adapted for these shredding uses. For example, it employs gravity flow with a pneumatic operated ram assist in the plastics loading section (12), a metered paper loading orifice to prevent the over loading of paper (14), and a collecting section (18) all easily accessible by the operator. In one embodiment, the machine (10) incorporates features associated with the loading of sections (12) and (14), and also in the collection section (18) which includes an air filtration system to collect any airborne dust that would be a potential biohazard. These features of the machine (10) are incorporated into the design to reduce the risk of injury or harm to the operator.

A. Loading System

The plastics loading section (12) of the illustrated embodiment is generally rectangular and has a length that is proportional to the anticipated length of the plastic products to be shredded, and includes a sliding cover (20) which when open allows the operator to put multiple plastic products of various sizes and shapes in the interior of the loading section (12). Operation of the machine motor (22) is prevented whenever the cover is slid open by the door switch (24) which is positioned on the mounting bracket (26). The door switch (24) is a snap acting switch, or it could be a variety of different types or styles that would achieve the same results. Electrical current is only allowed to flow when the sliding cover (20) is in the closed position. The door switch (24) is connected by wiring to a programmable logic controller (PLC), (30) in a manner well known in the electrical motor control art that prevents operation of the machine motor (22) when the sliding cover is open (20). Once the operator puts plastic products into the interior of the loading section (12) and slides the cover (20) to the closed position, the door switch (24) sends a signal to the PLC (30) which immediately starts the motor (22) and starts the process of shredding the plastic products. If at any time the sliding cover (20) is opened while the machine is in operation it trips the door switch (24), which then immediately shuts down the machine.

The loading section (14) for the shredding of the paper products in the illustrated embodiment is part of a formed cover (11) which has an opening that is funnel-like in shape and has a width greater than an 8½" standard sheet of paper in this embodiment. The loading section (14) has a metered orifice (13) to prevent the machine from being over loaded with paper products and also makes it more difficult for the operator to put his hand or fingers into the cutting section (16). Operation of the machine motor (22) is automatic by using a paper present sensor (15) which is mounted to the paper deflector (17). When the operator loads paper into the loading section (14), the sensor's (15) fine point beam is blocked and sends a signal to the PLC (30) to start the machine motor (22). Specifically, the sensor (15) is a photoelectric sensor that detects when the sensor's beam is blocked. The sensor (15) is capable of working in dark, light, dusty, and dirty conditions. Once the paper products are no longer blocking the beam of the sensor (15), the machine motor (22) continues to run an additional few seconds before shutting down to ensure that the paper product has passed through the cutting section (16). The sensor (15) is connected by wiring to the PLC (30) in a manner well known in the electrical motor control art. The use of the photoelectric sensor (15) is one method for triggering operation of the machine, but the same purpose can also be accomplished by other various mechanisms including a simple operator controlled on/off switch.

B. Motor

The machine motor (22) in the illustrated embodiment provides power for the operation of the entire cutting section (16) of the machine (10). The motor (22) is direct coupled to a cam roller reduction component (19) to obtain the torque requirements required at the drive sprocket (21). This is one method for obtaining the required reduction, but it can also be done in various other ways well known in the art of reduction methods. The reduction component (19) is mounted to a plate (23) which is adaptable to various reducer manufacturers. The mounting plate (23) incorporates a method to adjust the tension of the drive chain (25) by utilizing an adjustment screw (100) which is mounted to the side frame (29). The drive sprocket is connected by a chain (25) to a larger sprocket (31) which directly drives one of a pair of shafts (32,33). In this case shaft (32) is the driven shaft. The main shafts of the machine (32,33) are used to cut the products in a manner which will be explained in detail below. The shafts are mounted in parallel and at an angle 40 degrees counterclockwise from vertical position in the illustrated embodiment, but could be mounted at an angle from 0-degrees to 90-degrees. For rotation in opposite directions and in the illustrated configuration, the shafts (32,33) have a spur gear (34) attached to each shaft. The spur gears transmit power/torque between the shafts (32,33). They also cause shaft (33) to rotate in the opposite direction of shaft (32), but at the same speed since the spur gears (34) have the same pitch diameter and tooth count. The design of this drive arrangement also includes a sensor (99) to detect a stalled condition by sensing the teeth on the driven sprocket (31). Sensor (99) may be a conventional proximity switch or other type of sensor capable of sensing the teeth on the driven sprocket (31). It is done by using a combination of space and time to detect the rotation of the sprocket. A certain count must take place over a given time and if the count is less than that programmed into the PLC (30), a stalled condition is detected. The motor (22) will reverse for a given time period, and then stop the machine operation completely until restarted by the operator.

C. Cutting Section

Figure 12:
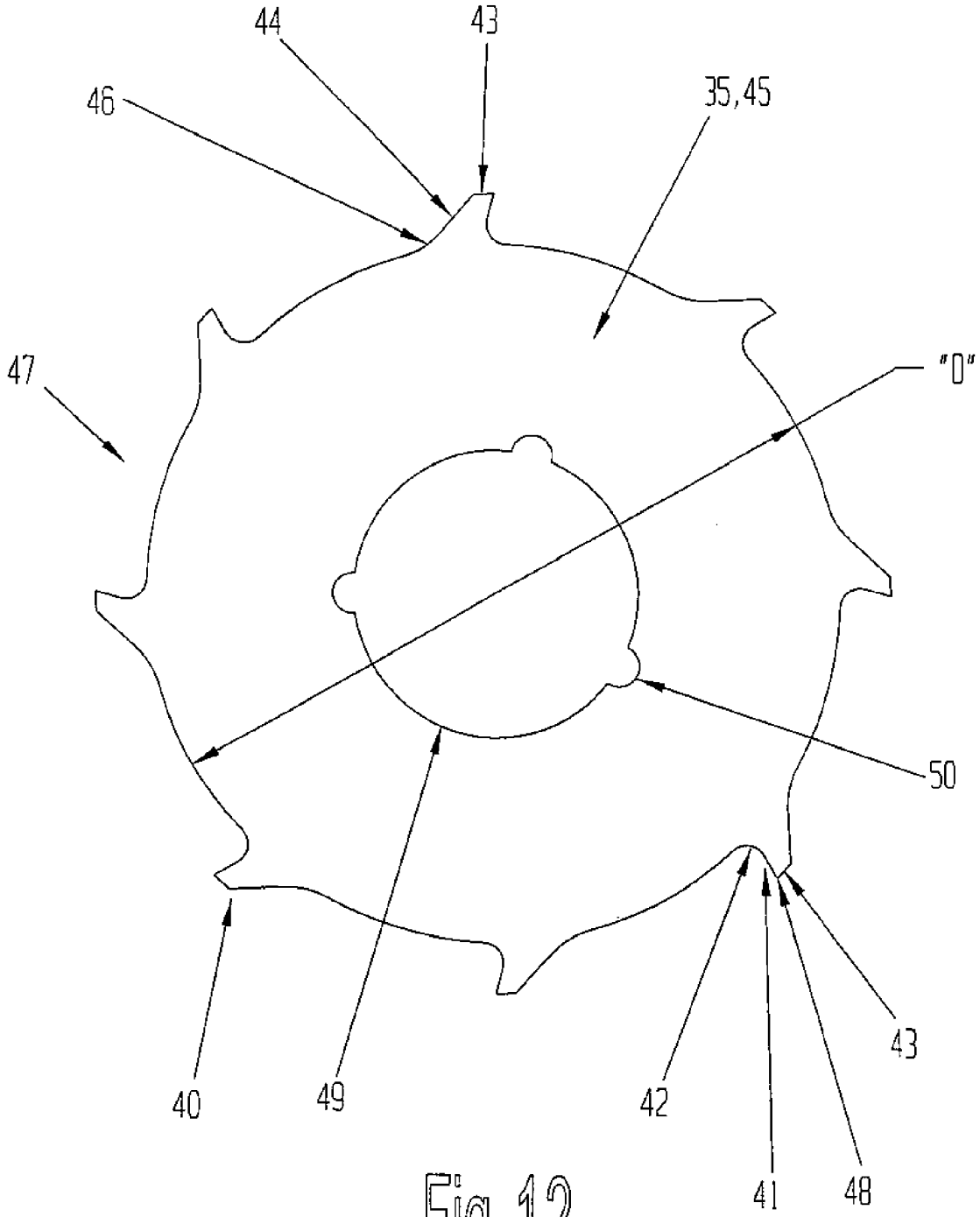
FIG. 12 is a simplified profile view of an individual cutter.
Figure 13:
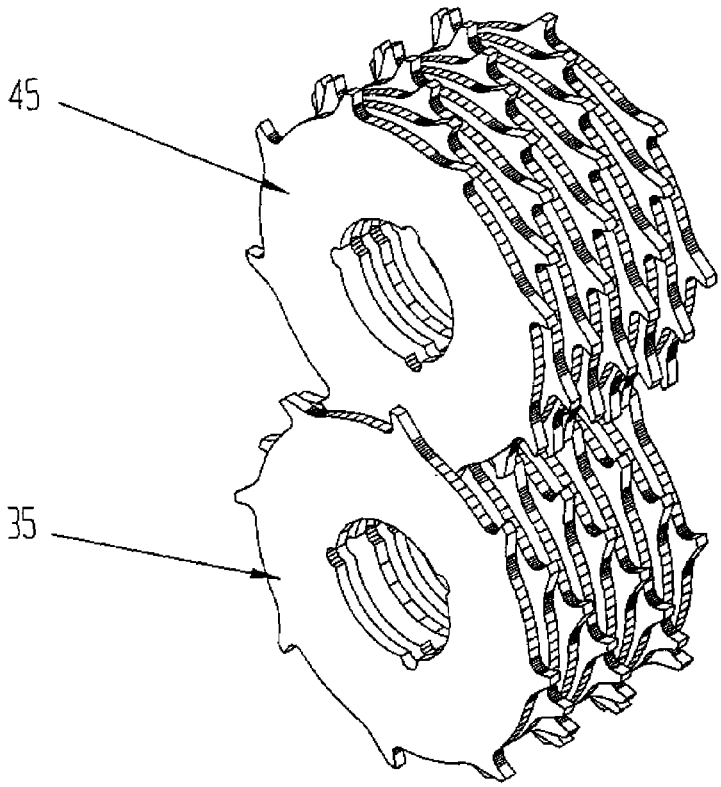
FIG. 13 is a simplified perspective view of a partial cutter stack-up showing the angular relationship of cutting teeth and upper and lower shafts.

As seen in FIGS. 1,2,3,4,9,12, and 13, the cutting section (16) includes a plurality of cutters (35,45) respectively mounted to the main shafts (32,33) in the illustrated embodiment. Each shaft has a longitudinal groove (36) with a hardened key (37) for mounting the cutters so that each individual cutter has an angular relationship to each adjacent cutter as shown in FIG. 13. This is one method of mounting and keying the cutters to the main shafts, but this could also be done by making the area of the shafts where the cutters are mounted to be splined. The cutters would have the spline broached to obtain the angular relationship as shown in FIG. 13. The main shafts (32,33) are supported on each end by radial ball bearings (38) which are pressed into the side frames (29,39). The cutters (35) mounted on the main lower shaft (32) in this embodiment are axially separated from the axially adjacent cutters (45) mounted on the main upper shaft (33). The cutters (35,45) are a different design from any of the cutters shown in the prior art machines disclosed in the patents referred to. The illustrated cutters are exemplary and the machine could include alternative cutters in other embodiments. The cutters as shown in FIG. 12 include a plurality of evenly spaced cutting teeth (40) with a root diameter (D). The main shafts (32,33) are separated by a distance between which is less than the root diameter (D) of the cutter to provide an overlapping effect of the cutters (35,45) which includes all of the radial heights and angular relations of the cutting teeth. Further, it should be noted that the illustrated cutting teeth (40) are unique in form but yet simple to provide.

The cutting teeth (40) are identical with an angular flat leading surface (41) which includes a radius (42) which is tangent to the angular flat leading surface (41) and the root diameter (D). The angular flat leading surface (41) extends out to the outer periphery (43) of the cutter, which forms a sharp horizontal edge (48) parallel to the shafts (32,33). This method effectively crushes and penetrates the intended products, but other methods could be used. The flat angular trailing surface (44) includes a radius (46) which is tangent to the flat angular trailing surface (44) and the root diameter (D). The flat angular trailing surface also extends to the outer periphery (43) of the cutter. The cutting teeth (40), their features, and the distance between the cutting edges (48) form a throat (47) between the teeth (40) which gives the cutters (35,45) an orifice with the ability to grasp the products of various shapes, sizes and configurations. Further, the width (T) of the cutters (35,45) is directly related to the size of the shredded particles. The bore (49) of the cutters (35,45) has 3 grooves (50) at unequal angles to each other. The cutters (35,45) are installed on the shafts (32,33) so that adjacent cutters do not have teeth in the same angular position to each other, which forms a helical pattern. The cutting teeth have sufficient integrity and cutting edges for gripping, cutting, and shredding the materials of the products. Further, the equal positioning of the teeth (40) and their familiar features makes it possible for the cutters (35,45) to be interchangeable and can be installed on either side of the shafts (32,33), with out affecting their effectiveness and integrity. This feature also reduces manufacturing costs and simplifies assembly. However, the interaction of the cutters (35,45) is not expected to do the cutting and the shredding alone. The profile of the individual teeth (40), the width (T) of the cutters (35,45) dictate the size of the shredded products particle size. The resulting particle size ensures compliance with the HIPAA privacy law requirements of destroying all personal and confidential medical information that would be on the pharmaceutical waste product labels.

The cutting section (16) also includes a plurality of upper shaft combers (51) and lower shaft combers (52) which are unique to the cutting section (16). The outer periphery (60) of the upper and lower combers (51,52) have a series of angles (61) that effectively guide the products into and through the cutting section (16) no matter which loading section (12,14) is in use. They also keep the area between the cutters (35,45) free of shredded particle build up. The upper shaft comber (51) is placed on the upper shaft (33) between each cutter (45) and is in-line with the cutter (35) on the lower shaft (32). The upper shaft combers (51) are of a width that is less than that of the cutter (45).

The upper shaft combers (51) are each mounted at holes (53) on a pair of tie rods (54) which extend across the width of the cutting section (16). The tie rods (54) are parallel to the main shafts (32,33) and are fastened to the inside of the side frames (29,39). Each upper comber (51) also has a hole (55) that wraps around the upper shaft (33). The lower shaft combers (52) are also at a width that is less than the width of the cutter (35). The lower shaft combers (52) are each mounted at holes (56) on a pair of tie rods (57) which extend across the width of the cutting section (16). The tie rods are parallel to the main shafts (32,33) and are fastened to the inside of the side frames (29,39). Each lower comber has a hole (58) that wraps around the lower shaft (32). The profiles of the combers (51,52) and the relationship of the upper shaft (33) which is mounted forty degrees from vertical position to the lower shaft (32), form a unique configuration where the loading sections (12,14) intersect at point (X). The cutter (35) on the lower shaft (32) can then direct the products into the cutting section (16). The illustrated combers are exemplary and the machine could include alternative combers in other embodiments. In other embodiments, the combers may be replaced with alternative structure to accomplish the function of the combers in other ways.

The cutting section (16) of the illustrated embodiment also includes a pair of spring plates (59) made from blue spring steel. A spring plate (59) is located on each side of the cutting section (16) between the side frames (29,39) and on the first and last cutter (35) of the lower shaft (32). The spring plates (59) are mounted on the tie rods (54,57) at holes (53,56). The holes (62) in the spring plates (59) are slotted so the spring plate (59) is allowed to flex when a side load is present. The spring plates (59) also have two holes (63) that wrap around each main shaft (32,33). Specifically, the spring plates (59) keep tension on the cutters (35) mounted on the lower shaft (32) which in turn apply tension to the cutters (45) on the upper shaft (33). This is one design of this machine (10), but it can also be done in a variety of different ways in the art of applying tension at a specific point. The illustrated method has shown that it is sufficient in keeping the cutters (35,45) from separating at the point of entrance of the cutting intersection (Y), of the root diameters (D) on the cutters (35,45), and the point of exit intersection (Z) of the root diameters (D) on the cutters (35,45). The spring plates (59) also absorb a substantial amount of the side loads generated by the intended products when being shredded in the cutting section (16), and distribute the force throughout the side frames (29,39) of the cutting section (16).

The cutters (35, 45) may be manufactured using conventional techniques and apparatus. For example, the cutters (35, 45) may be laser cut from hot rolled plate, such as 1045 hot rolled plate. The cut profile may then be carburized and heat treated to a hardness in the range of Rockwell 56 to 58. The hardness may vary from application to application. The cutters (35, 45) can then be finish ground to shred width specifications.

D. Ram and Ram Housing

As described, the cutting section (16) and the loading section (12) will cut and shred the plastic products when loaded into the loading section (12), even though the loading section (12) is perpendicular to the cutting section (16), and as gravity acts upon the product to pull it into the cutting section (16).

The machine (10) has a pneumatic actuated ram in the illustrated embodiment that helps push and force the plastic products into the cutting section (16). The ram is shown solid on FIG. 9 in the forward position, and shown phantom in the fully retracted position. The loading section (12) in this embodiment consists of three main parts, which are the ram (64), the housing (65), and the paper deflector (17). All three of these parts have a direct relationship in the shredding of the plastic products. They also have unique features that are part of the shredding of the paper products, in how they guide and deflect paper products into the cutting section (16) when loaded into the loading section (14).

The three parts of the loading section in this embodiment are configured in this way: the ram (64) is guided internally in the housing (65). The housing (65) is formed in a way that it makes a chamber for the loading of the plastic products in the loading section (12). Attached to the housing is a formed paper deflector (17) which makes up approximately 50 percent of the surface required to guide and deflect the paper products into the cutting section (16) from the loading of the paper products into the loading section (14). The ram (64) not only forces the said plastic products into the cutting section (16) but the formed shape of the face of the ram (64) makes up the remaining 50 percent of the paper guide and deflector when the ram is in the forward position and not in use when shredding the plastic products. Certain features of the machine (10) will be more fully explained below.

Figure 1:
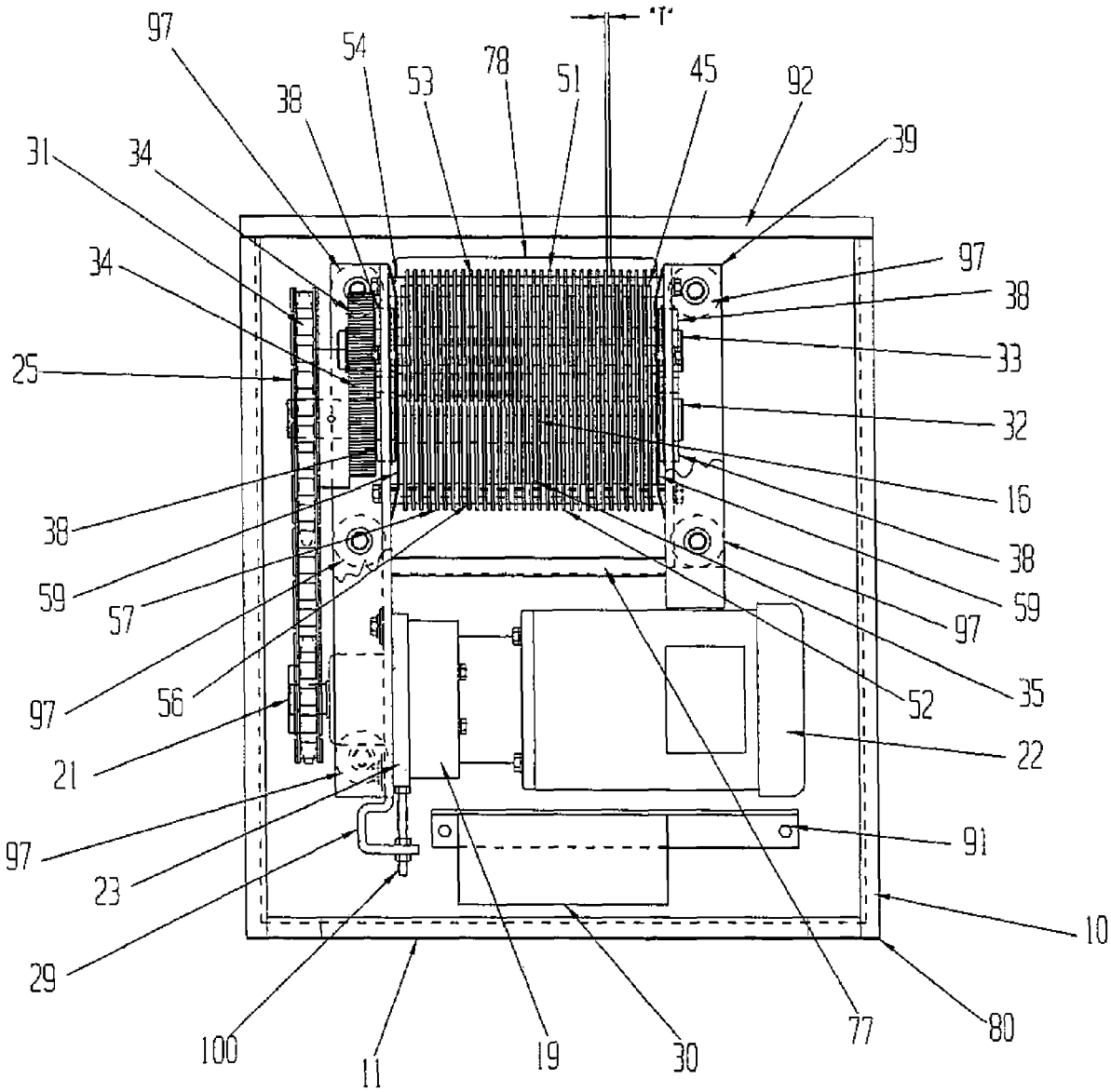
FIG. 1 is a simplified top view of the cutting section and drive components of the cutting head.
Figure 2:
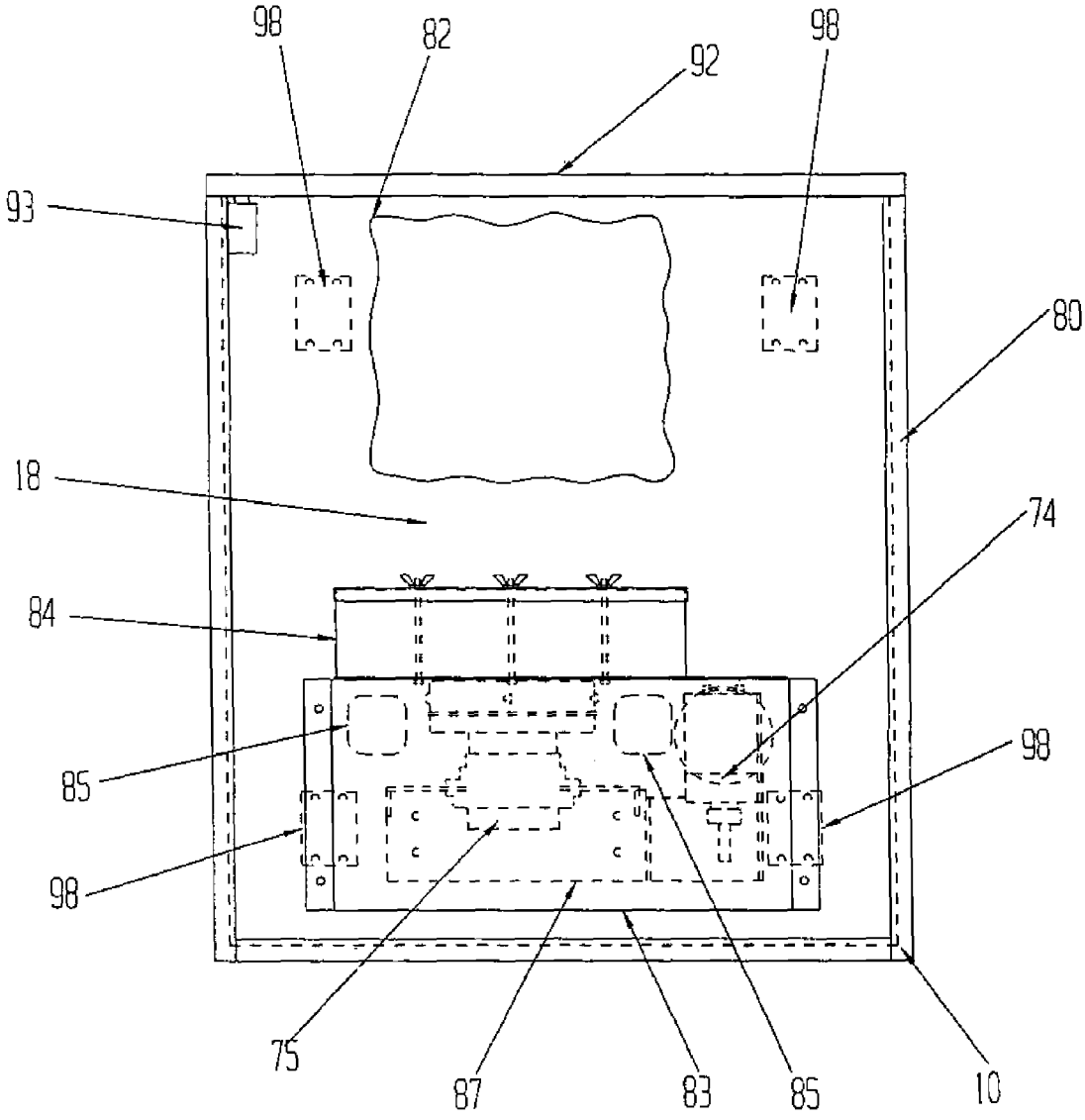
FIG. 2 is a simplified sectional view of the collection system.
Figure 3:
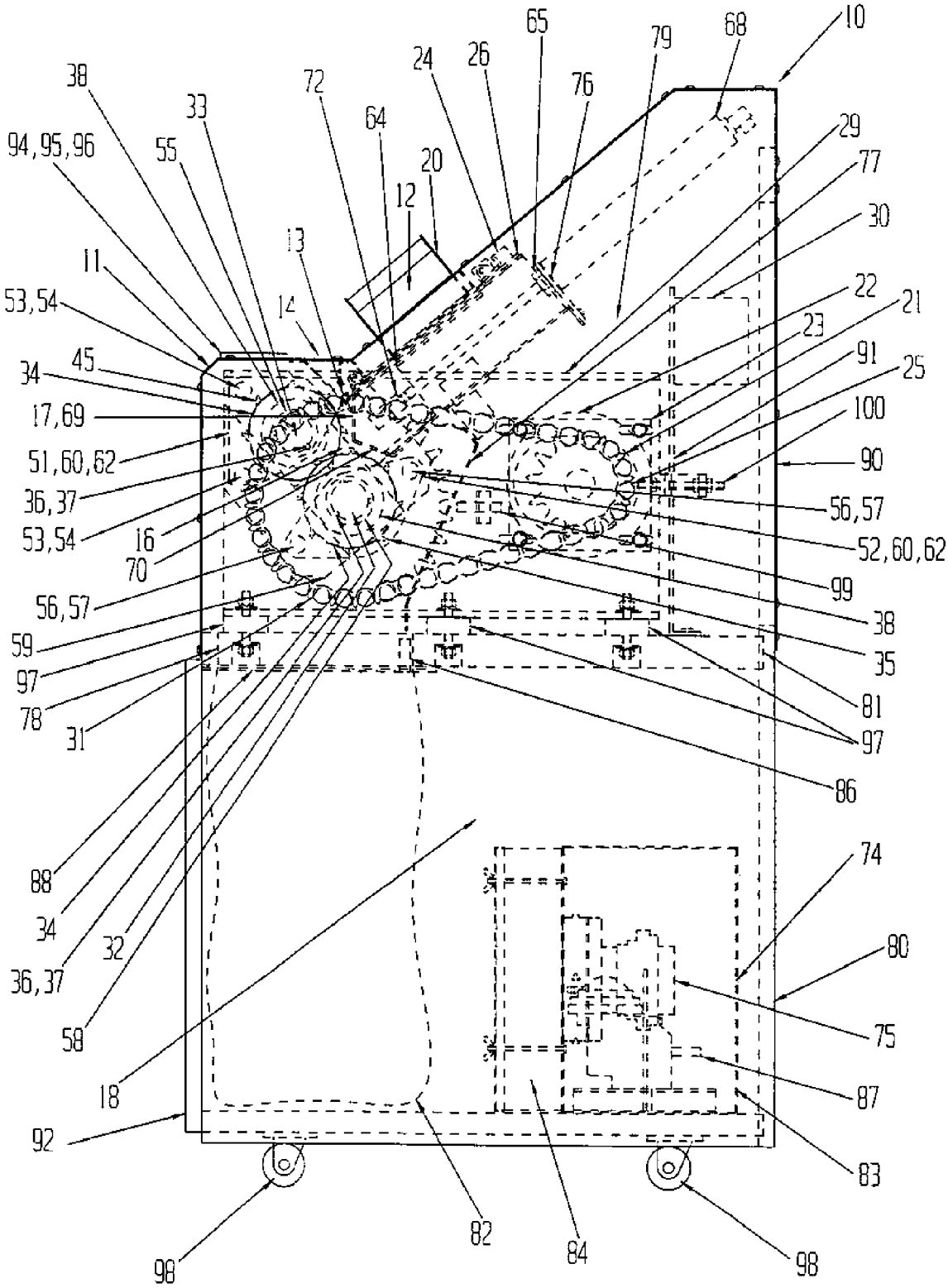
FIG. 3 is a right elevational view of FIG. 1 including various features of the invention.
Figure 4:
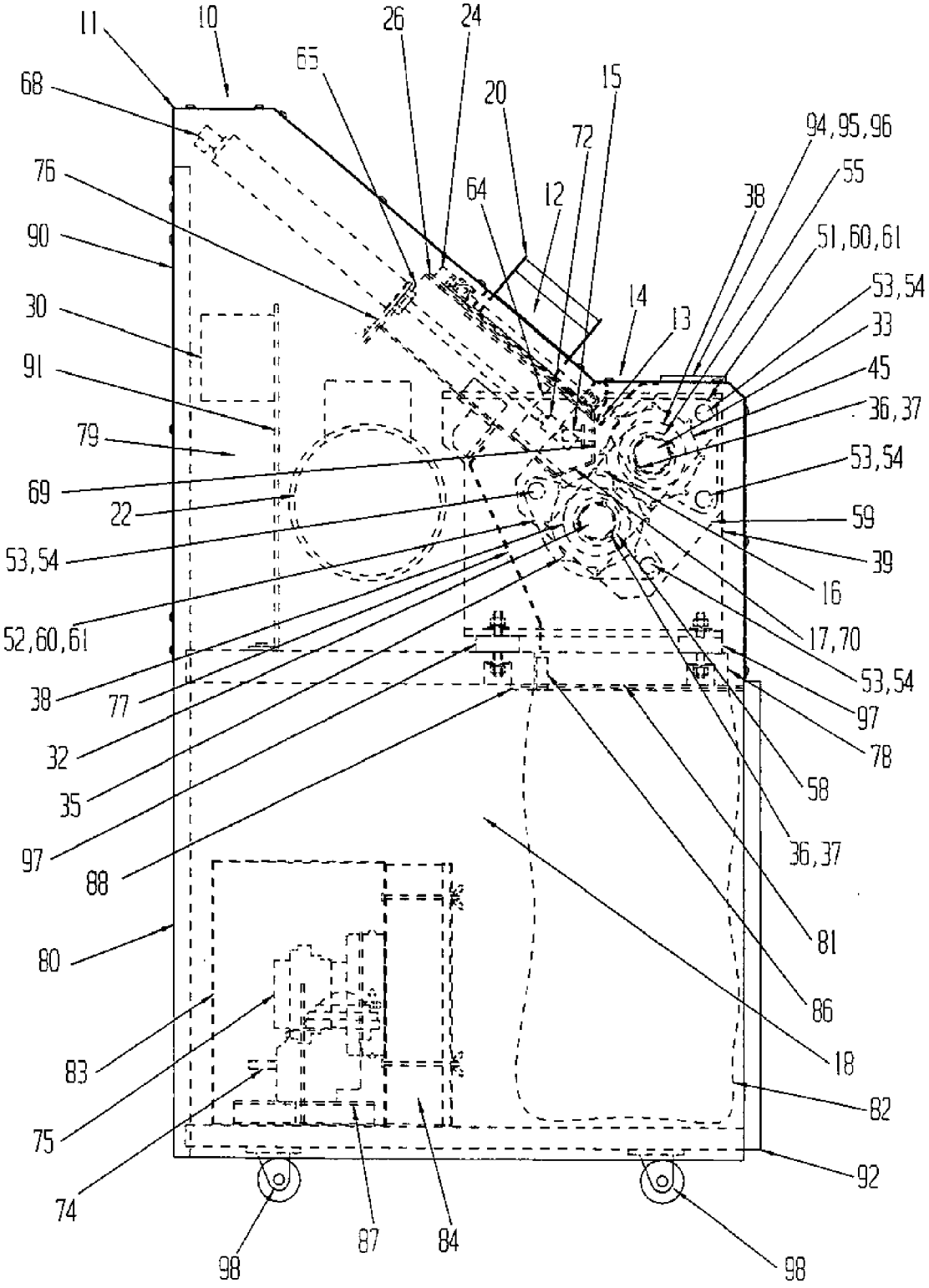
FIG. 4 is a left elevational view of FIG. 1 including various features of the invention.
Figure 5:
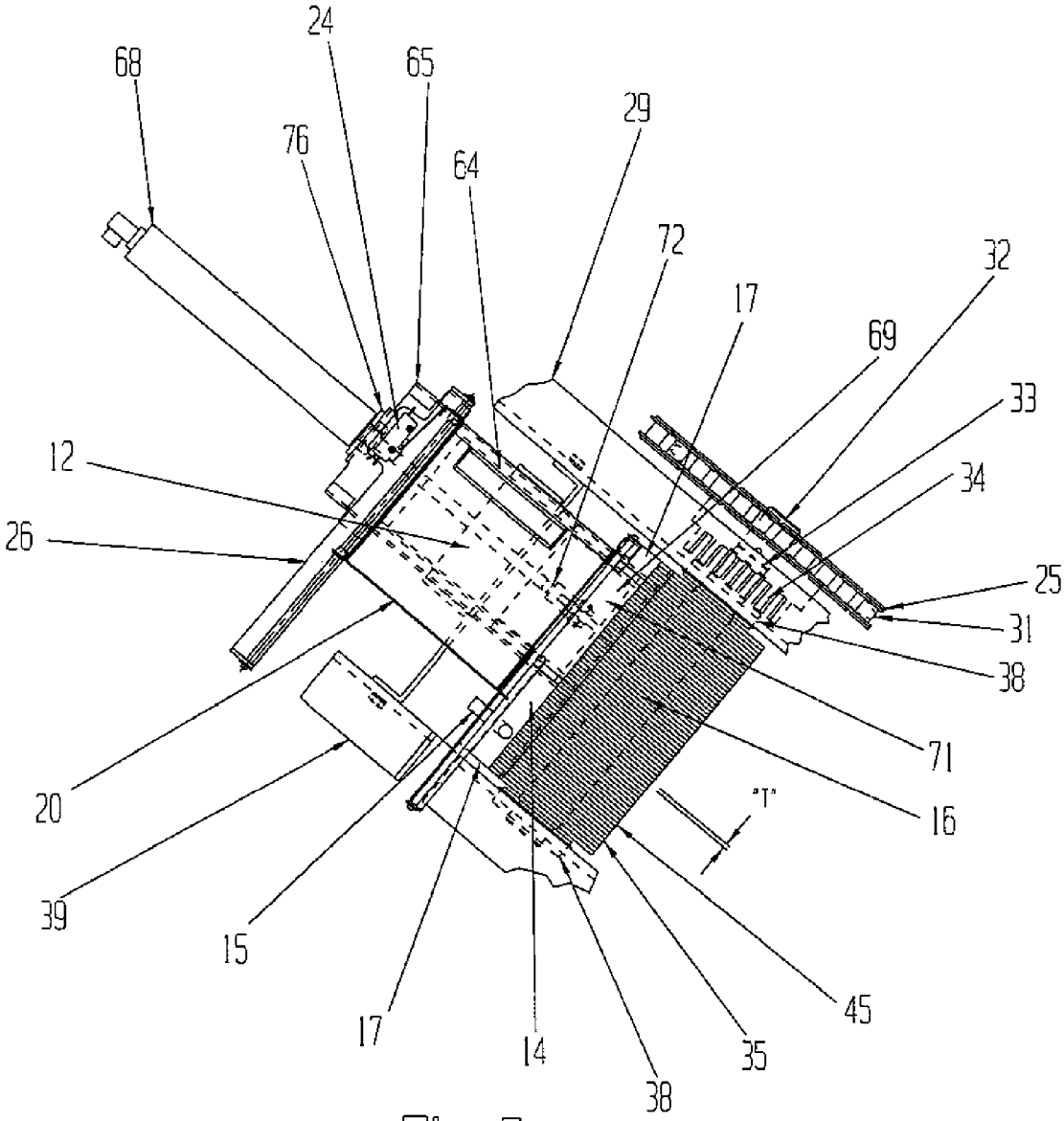
FIG. 5 is a simplified auxiliary top view of FIG. 4 showing various features of the ram and housing, and their related components.
Figure 6:
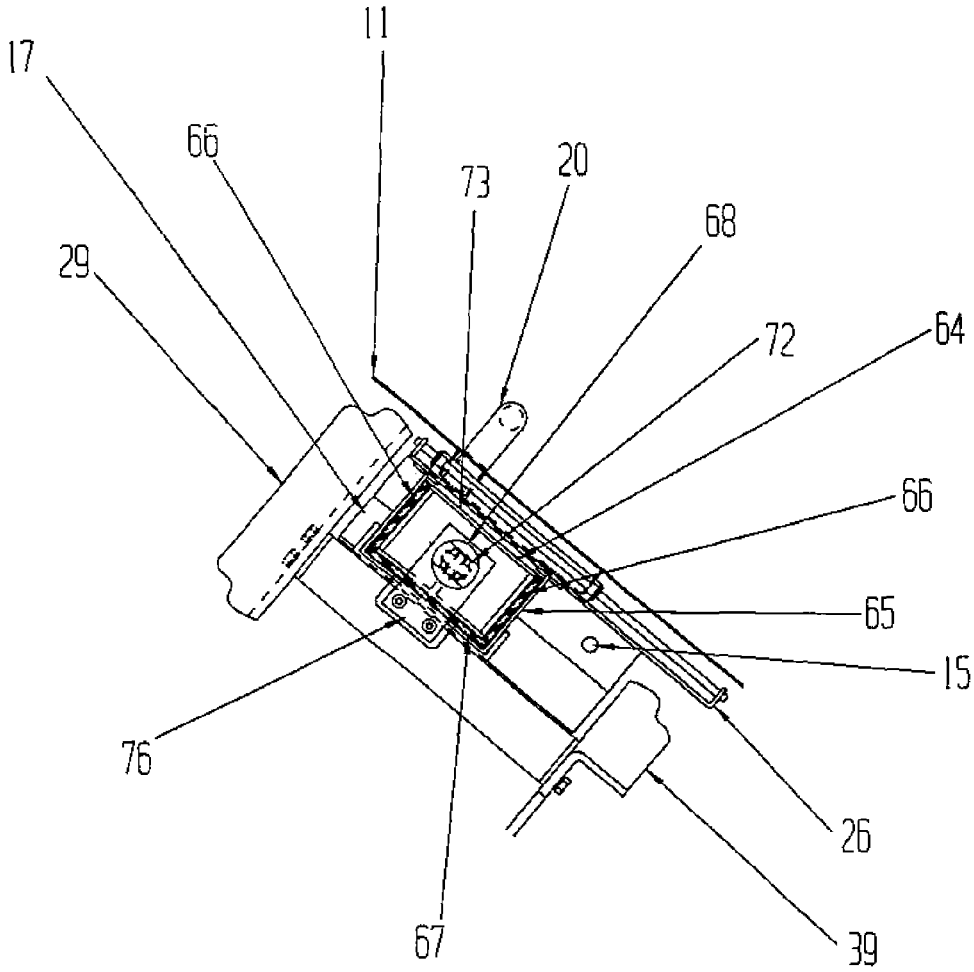
FIG. 6 is a simplified auxiliary rear view of FIG. 4 showing various features of the ram and the housing, and their related components.
Figure 7:
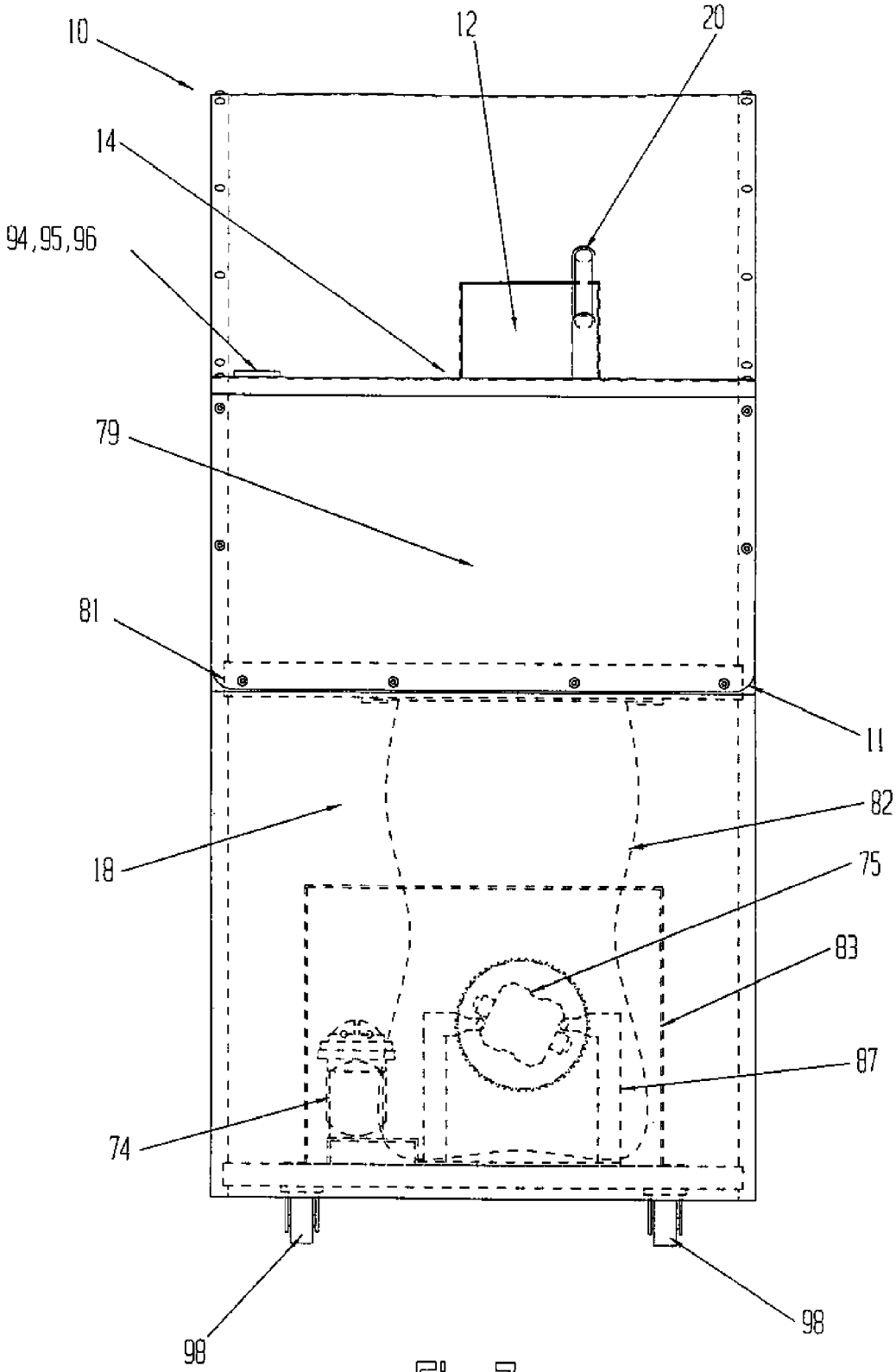
FIG. 7 is a simplified front view of the machine taken from FIG. 1.
Figure 8:
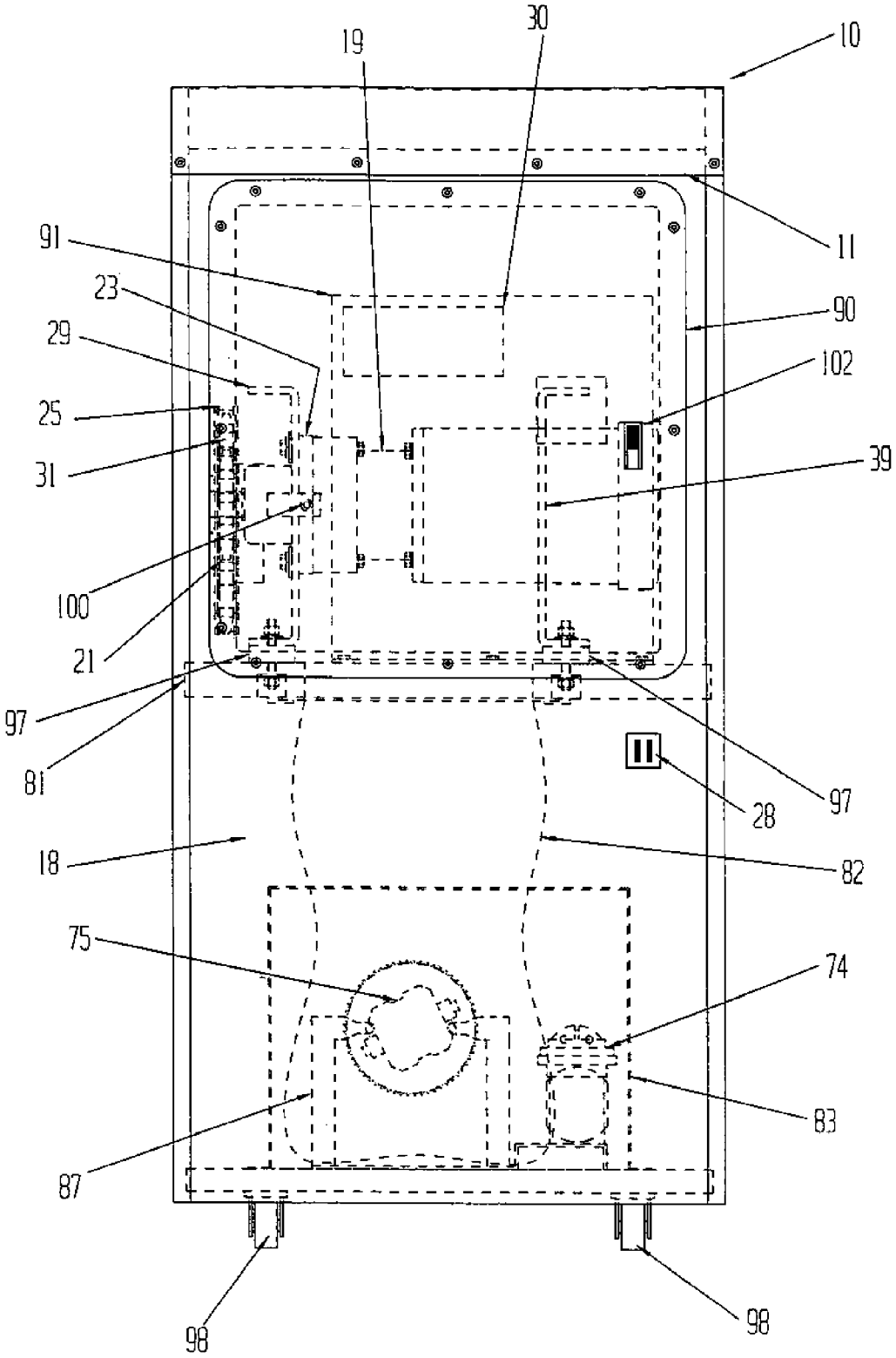
FIG. 8 is a simplified rear view of the machine taken from FIG. 1.
Figure 9:
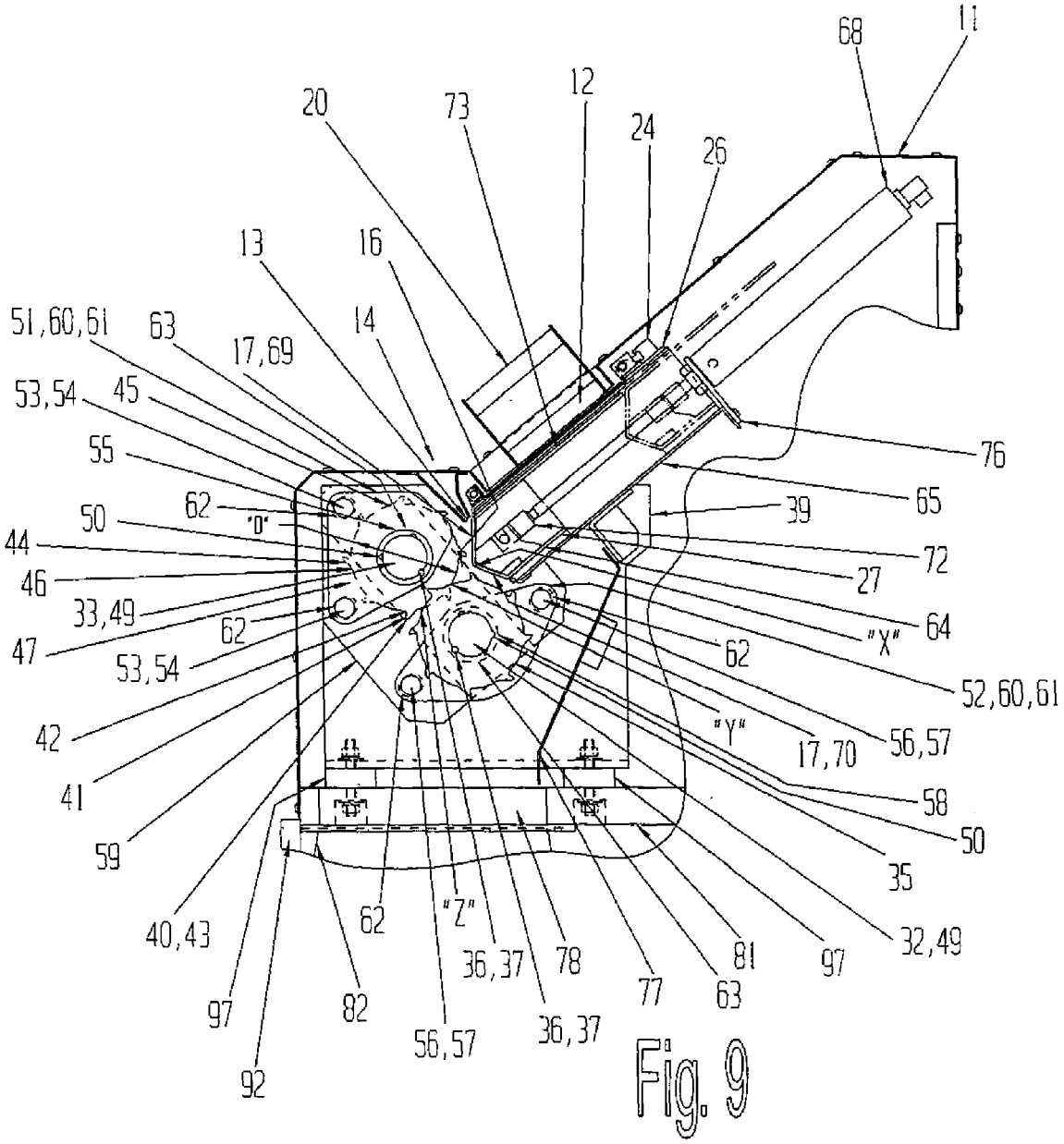
FIG. 9 is a simplified sectional view of the cutting section, loading sections, ram, ram housing, and the paper deflector of the machine.

As seen in FIGS. 5,6, and 9, the ram (64) has a formed shape, and mounted to the ram (64) are three wear pads (66,67) made from polyethylene ultrahigh molecular weight (UHMW). Although this is the material for the illustrated embodiment, it could also be made from materials that have similar properties and wear characteristics. One wear pad (66) is mounted to each side of the ram (64) and the third wear pad (67) is mounted to the underside of the ram (64). The UHMW wear pads (66,67) are used to reduce the coefficient of friction and to prevent the metal-to-metal contact of the ram (64) and the housing (65) when the ram (64) is actuated during the shredding of the plastic products. The ram (64) has the same rectangular shape as the housing (65) when the wear pads (66,67) are mounted to the ram, but the outside periphery of the assembled ram are slightly under sized to provide a running clearance on the sides between the wear pads (66) and the housing (65). The wear pad (67) is always in contact with the housing (65). As seen in FIG. 9, the ram (64) has a top leg (73) which is longer in length than the bottom leg (27). This is an additional safety feature that completely closes off the loading section (12) under the sliding cover (20) that provides access to the loading section (12), which was explained above. The ram (64) has a formed face that consists of an angle (69) that is perpendicular to the lower shaft (32), and a back angle (70) on the underside of the ram (64). These angles combined have the identical form as the paper deflector (17), which is mounted to the housing (65). When loading the paper products into the loading section (14), the ram (64) remains in the forward position, and closes off the discharge opening (71) of the housing (65) for shredding of the plastic products. When the face of the ram (64) is in the forward position, it must be in-line with the contour of the paper deflector (17). This is done in the illustrated embodiment by adjusting the clevis (72) mounted on the end of the rod on the pneumatic cylinder (68). When the operator loads the paper products into the loading section (14), the paper products deflect off the face of the ram (64) at angle (69), and the same angle (69) on the paper deflector (17), and guides its way into the cutting section (16).

When loading the plastic products into the loading section (12) of the illustrated embodiment the ram (64) automatically retracts to the position as shown in FIG. 9. This happens when the sliding cover (20) is opened, which trips the safety switch (24) which was explained previously. This sends a signal to the PLC (30) to start the air compressor (74), which sends air to the pneumatic cylinder (68) and then retracts the ram (64). When the sliding cover (20) is fully opened and the ram (64) is in the retracted position, it gives the operator full access to the loading section (12) to fill the chamber of the housing (65) with the plastic products. Once the operator slides the cover (20) to the closed position, the switch (24) sends a signal to the PLC (30) which immediately starts the motor (22) to start the shredding process in the cutting section (16). It also starts the air compressor (74) to actuate the pneumatic cylinder (68) to push and force the plastic products into the cutting section (16) until the ram (64) is extended to the forward position. This trips the internal switch of the air cylinder, which will be discussed in detail below, and sends a signal to the PLC (30) to let the motor run for a few seconds to ensure all of the plastic product is through the cutting section (16). The angle (70) on the underside of the ram (64) applies a downward force that helps control the plastic products entering the cutting section (16).

The pneumatic cylinder (68) is mounted to the back of the housing (65) on a mounting plate (76). It has the manufacturer's magnetic reed switches attached to the cylinder to detect the position of the ram (64), which also provides input to the PLC (30) to sense the extended and the retracted position of the ram (64). The circuit is designed to use compressed air to act like a spring to keep constant pressure on the ram (64), which pushes and forces the plastic products into the cutting section (16). This is done in a conventional manner using a 3-way and 4-way valve in an in-line configuration to trap air in the piston end of the pneumatic cylinder (68). All of the pneumatic components that are required in the machine (10), but not explained, are done in a way well known in the art of pneumatics and controls.

E. Material Filtration/Collection System

The collection section (18) is located below the cutting section (16) in the illustrated embodiment, and they are both separated by the middle shelf (81) of the cabinet (80). Attached to the underside of the middle shelf (81) is a filtration bag (82), which is a fiber material similar to that used in a vacuum cleaner. This is the one method for this embodiment, but could be any type of arrangement that would collect the waste product and filter air borne particles. This arrangement allows for the shredded products to fall through the opening (78) in the middle shelf (81), and collect in the filtration bag (82). The machine (10) is such that the cabinet (80) makes the collection section (18) a negative pressure flow system by mounting a vacuum (75) in the collection section (18) of the cabinet (80). Then, anytime the machine is in operation the vacuum is always on and running which is programmed into the PLC (30). The vacuum (75) pulls air through the orifice (13) of the loading section (14) and also through the small gaps in the loading section (12), which causes any airborne particles to be pulled into the filtration bag (82). The vacuum is mounted in its own enclosure (83) and mounted to the bottom of the cabinet (80). Mounted to the face of the enclosure (83) is a HEPA air filter (84) whose purpose is to collect any remaining airborne particles that are not collected by the filtration bag or may pass through the filtration bag. Also inside the enclosure (83) is the air compressor. Both the vacuum (75) and the air compressor (74) are mounted on a bracket (87), which are fastened to the cabinet (80). Basically, this enclosure arrangement allows for clean air to pass through the bottom of the cabinet (80) at holes (85). This design also works to cool the vacuum motor and the air pump and also the main motor (22). Mounting the vacuum (75) and the air compressor (74) in their own enclosure (83), which is in the collection section (18) of the cabinet (80), greatly reduces the decibel levels that are generated when the machine (10) is in operation. Also, included in the collection section (18) is a bag full indicator (86) that detects the material level of the filtration bag (82). This mechanism senses the level of material in the bag, rather than by weight or by volume. The bag full indicator (86) is programmed through the PLC (30).

This feature has a time delay to allow material to fall past the sensor without tripping it and shutting down the machine when there is still product in the cutting section (16). Once the filtration bag is full the machine will no longer run until the filtration bag is removed and emptied or replaced. The filtration bag (82) is easily removed by sliding it out of its retainer (88).

The cabinet (80) is made from melamine industrial grade 45# density, 100 gram paper with 2 mm edging. The cabinet (80) can alternatively be made from a variety of different materials. The cabinet has 2 sections; the collection section (18) described above, and the section (89) where the main components of the machine (10) are located and mounted. At the back of the cabinet (80), there is a removable access panel (90), which when removed gives access to the controls panel (91) for maintenance or service. Located at the front of the cabinet (80) is a lower access door (92), which gives the operator access to the collection section (18) to remove or replace the filtration bag (82). The lower access door (92) has a safety switch (93) to stop operation of the machine anytime the door is opened. Further, the top of the cabinet (80) is closed off with a formed removable cover (11) which includes indicator lights (94) for alerting to power on, and bag full condition (86). Also the cover has two push buttons (95) to allow for manual operation of forward and reverse operation and a stop button (96) to stop operation. When either are used, the machine will need to be reset before operation can continue. Located in the back of the cabinet (80) is a main circuit breaker to protect the electrical systems, and also can be used to turn power on and off. All of these safety features are wired and programmed into the PLC (30) in a manner well known in the art of electrical components and their controls. The side frames (29,39) of the cutting section (16) are mounted on vibration damping isolators (97) to lesson the transfer of sound to the cabinet (80). The vibration damping isolators are fastened to the middle shelf (81) of the cabinet (80). The machine (10) has four casters (98) mounted to the bottom of the cabinet (80) for ease of mobility of the machine. Also, mounted to the middle shelf (81) is the controls panel (91) of this embodiment.

F. Capacity and Controls

There is additional information about the illustrated embodiment which might be of interest. The machine (10) can easily shred up to 30 sheets of the paper products when inserted into the loading section (14). The machine (10) can easily shred various sizes, shapes and combinations of the plastic products and the various materials they are made of. The amount of plastic products that can be loaded into the loading section (12) is based upon the operator filling it to maximum capacity which is approximately 125 cubic inches. There are many other combinations and variables that could occur. The overall height of the machine (10) is about 4 feet-2½ inches by a width of 2 feet and at a depth of about 2 feet-3 3/16 inches. The loading section (12) is at a 40 degree angle from horizontal and is at about 3 feet-4 inches from the floor to the approximate center of the loading section (12). The loading section has a formed opening in the cover (11) that is about 6 inches wide by 6½ inches long and about 1 inch in depth. The housing (65) of the loading section (12) is rectangular in shape and creates a loading chamber that is about 5 inches in width by about 8 inches in length and about 3⅛ inches in depth. The paper loading section (14) is 3 feet-2 inches from the floor, the initial opening for loading is about 1⅝ inches in width by 9¾ in length. This funnels down at a 45 degree angle to a depth of about 2 inches, which then forms the paper metering orifice (13), which is about 3/16 inches in width and 9¾ inches in width.

The cutting section (16) is about 10 inches in width to include sixty five cutters (35,45). Each main shaft (32,33) has a diameter of about 1¾ inches. The cutters (35,45) are about 5/32 of an inch in width and have an outside diameter of about 4⅞ inches. The root diameter (D) is about 4¼ inches with a tooth height of about 5/16 of an inch. There are 8 evenly spaced cutting teeth (40), with the leading surface (41) at a 15 degree angle from vertical and a trailing surface (44) at an angle about 42 degrees from vertical. The outer periphery is at about 87 degrees from horizontal. The ball bearings (38) are double sealed and have a snap ring groove and snap ring and are pressed into the side frames (29,39) to a depth up to the snap ring. The combers (51,52) have an overall thickness (T) of 12 gauge sheet steel. The actual shredded particle size of the said products is 5/32 of an inch in width and at various lengths, which results in a volume about ⅛ of the original volume.

The machine (10) has a ¾ horsepower electric motor (22) mounted to reducer (19) that has a ratio of 87:1. The motor through the sprockets (21,31) and chain (25), power the cutting section (16) to turn at a speed of about 9 R.P.M. This gives the machine (10) sufficient torque levels in the cutting section (16) to effectively shred the said products without jamming the cutting section (16). The machine (10) in this embodiment also has a master on/off switch (102) which is located at the rear of the machine, and a main power supply connection (28).

The machine can also be fitted with a coin acceptor (101), as shown in FIG. 10. This would allow an individual/customer to shred their own confidential waste materials, while at the same time the coins would provide income for the owner of the machine (10).

The pneumatic cylinder (68) of the machine (10) has a bore of 1½ inches with a stroke of 8 inches. The cylinder is double acting and has a front nose mounting, attached to the end of the piston rod is a female clevis (72), which the ram (64) is attached.

The collection system (16), which is located in the lower part of the cabinet (80), has internal dimensions of about 1 foot-10½ inches in width by 2 feet-1 11/16 inches, and a height of approximately 1 foot-8½ inches. The filtration bag (82) is rectangular and is 10 inches wide by 9 inches deep, with a length of approximately 1 foot-8 inches. The filtration bag (82) has a flange at the top of the bag that slides into a formed retainer on the underside of the middle shelf (81), which seals the area of the opening (78) in the middle shelf (81).

This information is only provided to give a fuller illustration of the described embodiment, but not to provide a limit on the scope of the present invention.

The above description is that of preferred embodiments of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The embodiments of the invention in which an exclusive property or privilege is claimed are defined as follows:

1. A shredding apparatus for use in shredding materials in retail pharmacies, comprising:

first and second loading sections, said first loading section including a cover movable between a closed position and an open position for selectively loading bulky materials, said second loading section including an elongate orifice for loading sheet materials;

a cutting section in fluid communication with said first loading section via a first pathway and said second loading section via a second pathway, said cutting section including first and second counter-rotating cutting shafts mounted to receive bulky and sheet materials from said first and second loading sections, respectively, whereby said bulky and sheet materials pass between said first and second cutting shafts from said first and second loading sections for shredding; and a collection/filtration system positioned below said cutting section to receive materials from said first and second loading sections through said cutting section, said collection/filtration system including a collection section housing, a filtration bag for collecting shredded materials, a filter, and a vacuum, wherein said filtration bag, said filter and said vacuum are enclosed within said collection section housing, said vacuum creating a negative pressure gradient when said cover is in a closed position to define an air flow path from the exterior of said shredding apparatus through said second loading section orifice to said cutting section via said second pathway and then through said filtration bag and said filter to the exterior of the shredding apparatus through an opening in said collection section housing to create a region of negative pressure at said first and second loading sections, said first pathway intersecting said second pathway in the air flow path upstream of said first and second cutting shafts, and said vacuum being positioned in the air flow path between said filter and the exterior of said shredding apparatus.

2. The apparatus of claim 1 wherein said negative pressure assists in drawing shredded materials into said filtration bag.

3. The apparatus of claim 2 wherein said filter is a HEPA filter for filtering air moved by said vacuum.

4. The apparatus of claim 3 wherein said HEPA filter is disposed between said vacuum and said filtration bag.

5. The apparatus of claim 1 further including a shelf separating said cutting section from said collection/filtration system, said shelf including an opening for shredded waste material to pass into said filtration bag from said cutting section.

6. The apparatus of claim 1 wherein said cover is a sliding cover.

7. A shredding apparatus for shredding materials in retail pharmacies, comprising:

first and second loading sections, said first loading section including a cover movable between a closed position and an open position for selectively loading bulky materials, said second loading section including an elongate orifice for loading sheet materials;

a cutting section in fluid communication with said first loading section via a first pathway and said second loading section via a second pathway, said cutting section including first and second adjacent cutting shafts, whereby said bulky and sheet materials pass into said cutting section and between said first and second cutting shafts from said first and second loading sections for shredding;

a collection/filtration section positioned below said cutting section to receive materials from said first and second loading sections through said cutting section, the collection/filtration section including a collection section housing and a filtration bag enclosed therein, wherein shredded materials pass into said filtration bag;

a vacuum configured to create a negative pressure gradient when said cover is in a closed position, whereby airborne fibers or debris are directed toward said filtration bag; and a HEPA filter associated with said vacuum, whereby said negative pressure gradient defines an air flow path from the exterior of said shredding apparatus through said second loading section orifice to said cutting section via said second pathway and then through said filtration bag and said HEPA filter to the exterior of the shredding apparatus to create a region of negative pressure at said first and second loading sections, said first pathway intersecting said second pathway in the air flow path upstream of said first and second cutting shafts, and said vacuum being positioned in the air flow path between said HEPA filter and the exterior of said shredding apparatus.

8. The apparatus of claim 7 wherein said filtration bag is further defined as a fibrous filtration bag, said fibrous filtration bag retaining substantially all of the shredded waste material.

9. The apparatus of claim 8 wherein said collection/filtration section includes a sensor and relay configured to stop operation of said cutting section when said filtration bag is substantially full of shredded materials.

10. The apparatus of claim 9 wherein said collection/filtration section includes an LED configured to illuminate when said filtration bag is substantially full of shredded materials.

11. The apparatus of claim 10 wherein said vacuum is configured to operate substantially simultaneously with said cutting section.

12. The apparatus of claim 11 wherein said cutting section is positioned above said collection/filtration section, wherein shredded waste material passes into said filtration bag.

13. The apparatus of claim 7 further including a shelf separating said cutting section from said collection/filtration section, said shelf including an opening for shredded waste material to pass into said collection/filtration section from said cutting section.

14. The apparatus of claim 7 wherein said cover is a sliding cover.

* * * * *